US008439015B2

(12) United States Patent
Kimura et al.

(10) Patent No.: US 8,439,015 B2
(45) Date of Patent: May 14, 2013

(54) FUEL INJECTION APPARATUS

(75) Inventors: Takahiko Kimura, Kanagawa (JP); Atsushi Osanai, Kanagawa (JP)

(73) Assignee: Mikuni Corporation, Tokyo (JP)

( * ) Notice: Subject to any disclaimer, the term of this patent is extended or adjusted under 35 U.S.C. 154(b) by 371 days.

(21) Appl. No.: 12/926,339

(22) Filed: Nov. 10, 2010

(65) Prior Publication Data

US 2011/0108003 A1 May 12, 2011

(30) Foreign Application Priority Data

Nov. 10, 2009 (JP) ..... 2009-257445
Nov. 9, 2010 (JP) ..... 2010-251330

(51) Int. Cl.
*F02M 69/46* (2006.01)

(52) U.S. Cl.
USPC ..... 123/456; 123/299; 123/300; 123/336; 123/442; 123/468

(58) Field of Classification Search ..... 123/299, 123/300, 304, 336, 337, 442, 447, 456, 468, 123/469, 470, 472, 478
See application file for complete search history.

(56) References Cited

U.S. PATENT DOCUMENTS

| | | | | |
|---|---|---|---|---|
| 5,168,839 | A * | 12/1992 | Hitomi et al. | 123/184.42 |
| 6,196,186 | B1 * | 3/2001 | Nagasaka et al. | 123/336 |
| 6,536,412 | B2 * | 3/2003 | Someno et al. | 123/436 |
| 6,863,046 | B2 * | 3/2005 | Laimbock | 123/308 |
| 7,134,425 | B2 * | 11/2006 | Taguchi et al. | 123/470 |
| 7,198,032 | B2 * | 4/2007 | Taguchi et al. | 123/470 |
| 7,370,845 | B2 * | 5/2008 | Kondo | 261/23.2 |
| 2005/0188959 | A1 * | 9/2005 | Udono | 123/470 |

FOREIGN PATENT DOCUMENTS

JP 2007-170349 7/2007

* cited by examiner

*Primary Examiner* — Stephen K Cronin
*Assistant Examiner* — Joseph Dallo

(57) ABSTRACT

A fuel injection apparatus including a plurality of throttle bodies, a fuel supply pipe to supply fuel to upstream and downstream side injectors; connecting pipes to connect the fuel supply pipe to the upstream side injectors and the downstream side injectors; upstream side branch passages to supply fuel branched from the fuel supply pipe to the respective upstream side injectors; downstream side branch passages to supply fuel branched from the fuel supply pipe to the respective downstream side injectors; a nip angle of the upstream side injectors is larger than a nip angle of the downstream side branch passages against the intake flow direction of the intake passage; and the nip angle of the downstream side branch passages is larger than a nip angle of the downstream side injectors against the intake flow direction of the intake passage.

8 Claims, 5 Drawing Sheets

FUEL INJECTION APPARATUS

CROSS-REFERENCE TO RELATED APPLICATIONS

This application claims the priority benefit of Japanese Patent Application No. 2009-257445, filed on Nov. 10, 2009, and Japanese Patent Application No. 2010-251330, filed on Nov. 9, 2010, in the Japanese Patent Office, the disclosures of which are incorporated herein by reference.

BACKGROUND

1. Field

Embodiments relate to a fuel injection apparatus to control an air-fuel ratio in a combustion chamber of an engine, and in particular, an embodiment relates to a fuel injection apparatus to control injection fuel corresponding to an operation range with plural injectors respectively provided to each cylinder.

2. Description of the Related Art

In the related art, it has been known that combustion efficiency at a combustion chamber of an engine is expected to be enhanced by arranging an injection direction of an injector to direct toward the vicinity of an intake valve of the engine. In a fuel injection apparatus having two injectors arranged respectively at each intake passage, a fuel supply pipe is arranged to commonly supply fuel to the injectors.

In the case that fuel is supplied to the two injectors respectively from the common fuel supply pipe, fuel inlet ports of the two injectors are required to be connected to the common fuel supply pipe. In this case, in order to suppress the length of the fuel injection apparatus in the intake flow direction, the upstream side injector is arranged to have a large angle of the injection direction against the intake flow direction not to be overhung from the throttle body. Meanwhile, the downstream side injector is preferably arranged along the direction toward the intake valve of the engine, as described above. Accordingly, large angle difference is required between the two injectors.

In the related art, it has been known that fuel supply pipe structure enables to enlarge angle difference between two injectors by arranging a connecting pipe for connecting one of the two injectors and a fuel supply pipe commonly used for the two injectors between the one injector and the fuel supply pipe, such as disclosed in, for example, Japanese Patent Publication 2007-170349.

Regarding the passage through which fuel is supplied from the fuel supply pipe of Japanese Patent Publication 2007-170349, the upstream side injector and the connecting pipe connected to the downstream side injector are arranged in parallel. In the case that the upstream side injector and the downstream side injector are arranged to have large angle difference therebetween so that only the injection angle of the downstream side injector is set to be along the intake passage, the connection portion between the connecting pipe and the downstream side injector is required to be largely bent. In that case, since the insertion direction of the downstream side injector is to be close to the direction perpendicular to the assembling direction of the fuel supply pipe, there is a fear that the assembling becomes unstable.

Here, in the case that the upstream side injectors and the downstream side injectors are previously assembled to the fuel supply pipe as sandwiching the respective connecting pipes to be a subassembly, it becomes difficult to assemble the subassembly to the plural throttle bodies. In the case of the fuel injection apparatus for a four-cylinder engine, for example, the injectors must be assembled in one process into eight insertion holes in total.

Meanwhile, in the case that the upstream side injector, the downstream side injector having the connecting pipe, and the fuel supply pipe are to be assembled sequentially to the throttle body, it is difficult to assemble to the plural throttle bodies. In the case of the fuel injection apparatus for a four-cylinder engine, for example, the fuel supply pipe to be assembled in the last is required to be assembled in one process with four connecting pipes and four upstream side injectors that is, eight portions in total.

In the case that fuel is supplied directly to the two injectors from the common fuel supply pipe, when only the injection angle of the downstream side injector is set to be along the intake passage so that the injection is performed in the direction toward the combustion chamber of the engine, the downstream side injector is required to be arranged at a position being far to the downstream side against the upstream side injector so as not to cause unacceptable bend at the fuel passage. Thus, the distance between the two injectors is required to be long. Accordingly, the throttle body is prolonged in the intake flow direction.

SUMMARY

To address the above issues, an aspect provides a fuel injection apparatus including plural intake passages and two injectors arranged to each intake passage to satisfy the following two points. The first point is that the angle difference between the two injectors is set to be large while suppressing the length of the throttle body in the intake flow direction. The other point is that assembling of the throttle body and the fuel supply pipe is facilitated.

Additional aspects will be set forth in part in the description which follows and, in part, will be apparent from the description, or may be learned by practice of the invention.

According to an aspect, a fuel injection apparatus includes a plurality of throttle bodies in which an intake passage communicated with an engine is respectively formed, an upstream side injector arranged to each throttle body to inject fuel to each intake passage, a downstream side injector arranged to each throttle body at the downstream side against the upstream side injector to inject fuel to each intake passage, a fuel supply pipe to commonly supply fuel to the upstream side injectors and the downstream side injectors, and a connecting pipe to connect the fuel supply pipe to the upstream side injector and the downstream side injector which are arranged at each throttle body. Here, an upstream side branch passage to supply fuel branched from the fuel supply pipe to the upstream side injector and a downstream side branch passage to supply fuel branched from the fuel supply pipe to the downstream side injector are formed at the inside of each connecting pipe. Then, a nip angle of the upstream side injector is larger than a nip angle of the downstream side branch passage against the intake air flow direction of the intake passage and the nip angle of the downstream side branch passage is larger than a nip angle of the downstream side injector against the intake air flow direction of the intake passage.

Further, in the fuel injection apparatus, the plurality of throttle bodies may be integrally molded. Furthermore, in the fuel injection apparatus, the fuel supply pipe and each connecting pipe may be fixed respectively to each throttle body commonly with respective fixing members.

Further, in the fuel injection apparatus, the plurality of throttle bodies may be integrally molded and a pair of throttle bodies of the plurality of throttle bodies may be integrally molded together. Still further, the fuel injection apparatus may include two pairs of integrally molded throttle bodies.

Further, the fuel injection apparatus may include a plurality of seals. The plurality of seals may include a first seal sealing the fuel supply pipe to a respective connecting pipe, a second seal sealing the connecting pipe to the respective upstream side injector, and a third seal sealing the connecting pipe to the respective downstream side injector. The plurality of seals may be flexible. Further, the plurality of seals may be o-ring seals.

According to the fuel injection apparatus, since the passage of fuel flowing through the upstream side injector and the downstream side injector is bifurcated at the inside of the connecting pipe, the upstream side injector, the downstream side injector and the connecting pipe can be previously assembled to be a subassembly. Accordingly, since the subassembly can be assembled to the throttle body for each intake passage, the assembling becomes facilitated. Then, since the fuel supply pipe supports only the connecting pipe, the support structure is simplified and reliability thereof is improved.

Next, since the direction of the downstream side branch passage in the connecting pipe is set to be more to the downstream side than the direction of the upstream side injector, in other words, to be closer toward the combustion chamber and the direction of the downstream side injector is set to be more to the downstream side than the direction of the downstream side branch passage, the direction of the downstream side injector can be set to be closer toward the combustion chamber of the engine being more to the downstream side than the direction of the upstream side injector. Here, since the angle between the upstream side injector and the downstream side injector is dependent to the angle of bifurcation within the connecting pipe as well as the angle of connection from the connecting pipe to the downstream side injector, the angle between the upstream side injector and the downstream side injector can be enlarged while suppressing the respective angles of the bifurcation and connection. Accordingly, fuel can be injected to a position close to the combustion chamber and injected fuel can be supplied to the combustion chamber more efficiently.

Further, since the angle between the upstream side injector and the downstream side injector is dependent to the angle of bifurcation within the connecting pipe 6 in addition to the angle of connection from the connection pipe to the downstream side injector, the distance between the downstream side injector and the upstream side injector can be shortened. Accordingly, even with the fuel injection apparatus having fuel supplied to the two injectors with the common fuel supply pipe, fuel can be injected to a position close to the combustion chamber of the engine while suppressing the length of the throttle body in the intake flow direction.

BRIEF DESCRIPTION OF THE DRAWINGS

These and/or other aspects will become apparent and more readily appreciated from the following description of embodiments, taken in conjunction with the accompanying drawings of which.

DESCRIPTION OF EMBODIMENTS

Figure 1:
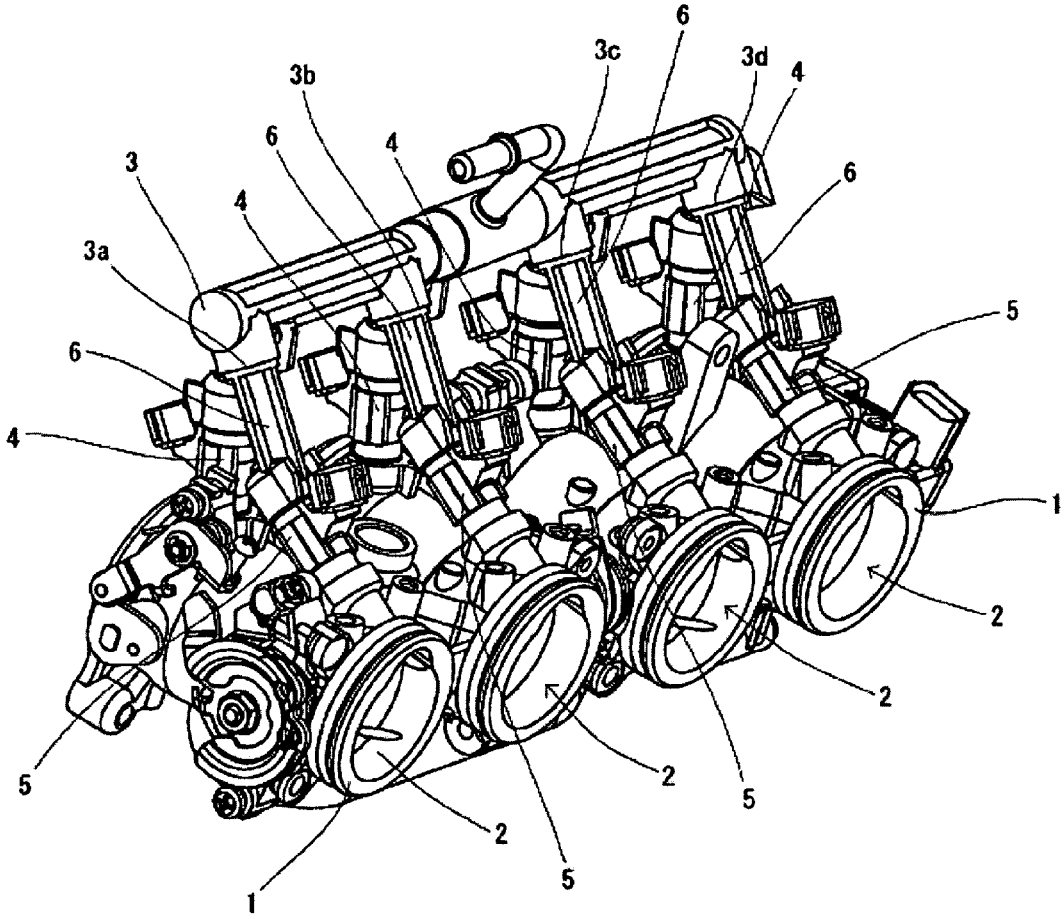
FIG. 1 is a general structural view of a fuel injection apparatus according to an embodiment.

Reference will now be made in detail to embodiments, examples of which are illustrated in the accompanying drawings, wherein like reference numerals refer to like elements throughout.

Figure 2:
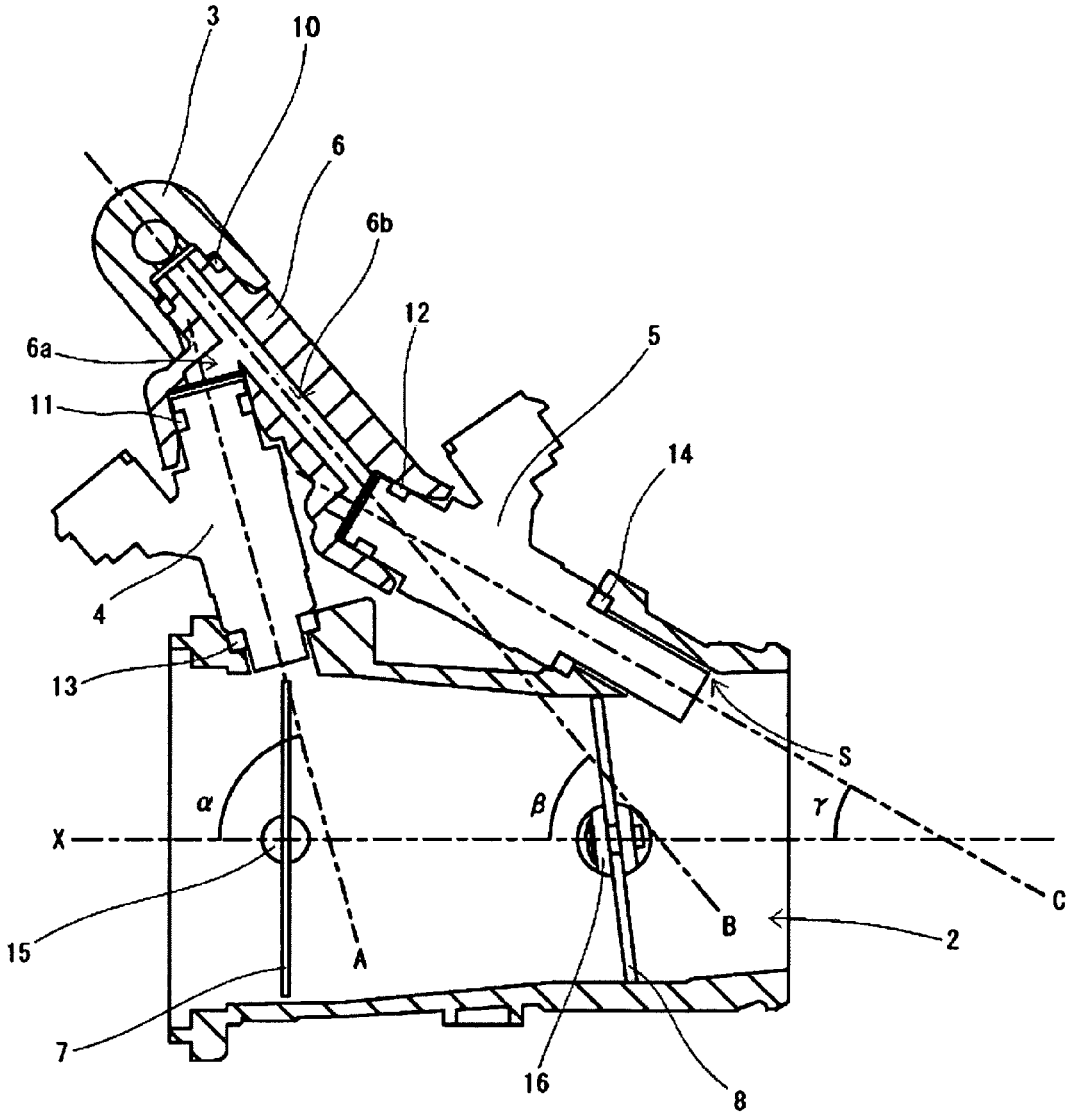
FIG. 2 is a main structural view of one intake passage of the fuel injection apparatus according to the embodiment.

First, general structure of a fuel injection apparatus according to an embodiment of the present invention will be described with reference to FIGS. 1 to 3.

The fuel injection apparatus according to the embodiment includes throttle bodies 1 respectively incorporating an intake passage 2 communicating with a combustion chamber of an engine (not illustrated), an upstream side throttle shaft 15 penetrating the throttle bodies 1 so as to be perpendicular to the respective intake passages 2, a downstream side throttle shaft 16 arranged at the downstream side of the upstream side throttle shaft 15 penetrating the throttle bodies 1 so as to be perpendicular to the respective intake passages 2 as well, upstream side throttle valves 7 fixed to the upstream side throttle shaft 15 to adjust intake air quantity of the respective intake passages 2, downstream side throttle valves 8 fixed to the downstream side throttle shaft 16 to adjust the air intake quantity of the respective intake passages 2, upstream side injectors 4 and downstream side injectors 5 to inject fuel to be controlled being based on fuel injection quantity, fuel injection timing and the like corresponding to operational states of the engine, a fuel supply pipe 3 to supply fuel pressure-fed from a fuel pump (not illustrated) to the upstream side injectors 4 and the downstream side injectors 5, connecting pipes 6 to respectively connect each upstream side injector 4 and each downstream side injector 5 to the fuel supply pipe 3, and fixing members 9 to fix the fuel supply pipe 3 and the connecting pipes 6 to the throttle body 1.

The throttle body 1 includes the intake passages 2 respectively communicated with combustion chambers of a four-cylinder engine, for example. The upstream side injector 4 and the downstream side injector 5 are arranged to inject fuel to each intake passage 2. The fuel supply pipe 3 is arranged as a common fuel passage to supply fuel to all of the upstream side injectors 4 and the downstream side injectors 5. The connecting pipe 6 includes an upstream side branch passage 6*a* and a downstream side branch passage 6*b* formed to distribute fuel flowing through the inside thereof. The upstream side branch passage 6*a* is connected to the upstream side injector 4 and the downstream side branch passage 6*b* is connected to the downstream side injector 5. Fuel supplied from the fuel supply pipe 3 to the connecting pipe 6 is sealed by a seal 10 such as an o-ring disposed at a connecting portion therebetween. Fuel supplied from the connecting pipe 6 to the upstream side injector 4 and the downstream side injector 5 is sealed by seals 11, 12 such as o-rings respectively disposed at each connecting portion therebetween. The upstream side injector 4 is arranged as being inserted to the vicinity of the upstream side throttle valve 7 via a seal 13. The downstream side injector 5 is arranged as being inserted to the vicinity or the downstream side of the downstream side throttle valve 8 via a seal 14. The fuel supply pipe 3 and each connecting pipe 6 are fixed to each of protruding portions 1*a* to 1*d* of the respective throttle bodies 1 by being screwed commonly with the fixing member 9. Air flowing into the engine is sucked through the intake passage 2 from the left to the right of FIG. 2, that is, from the upstream side to the downstream side.

Next, a supply route of injection fuel according to the embodiment will be described with reference to FIG. 2.

The fuel pressure-fed to the fuel supply pipe 3 is supplied from the fuel supply pipe 3 to the upstream side injectors 4 and the downstream side injectors 5 via the connection pipes 6 and is injected to the inside of the respective intake passages 2. The fuel flowing through the inside of the connecting pipe 6 is distributed into the upstream side branch passage 6*a* and the downstream side branch passage 6*b*. The fuel supplied to the upstream side injectors 4 and the downstream side injectors 5 are injected to the inside of the respective intake passages 2 based on the controlled fuel injection quantity and the like. The fuel supplied to the upstream side injector 4 is injected to the vicinity of the upstream side throttle valve 7 and the fuel supplied to the downstream side injector 5 is injected to the vicinity or a downstream position of the downstream side throttle valve 8 toward the combustion chamber of the engine.

Next, positional relation among main parts according to the embodiment will be described with reference to FIG. 2.

In the following description, line X denotes a line passing through the upstream side throttle shaft 15 and the downstream side throttle shaft 16. Angle α denotes an angle nipped by line X and fuel-injection direction A at an injection opening of the upstream side injector 4. Angle β denotes an angle nipped by line X and fuel-flow direction B through the downstream side branch passage 6*b*. Angle γ denotes an angle nipped by line X and fuel-injection direction C at an injection opening of the downstream side injector 5. Here, the upstream side injector 4, the downstream side injector 5 and the connecting pipe 6 are attached to the throttle body 1 so that angle α is larger than angle β and angle β is larger than angle γ.

Further, clearance s denotes clearance between the downstream side injector 5 and the throttle body 1 at the position where the downstream side injector 5 is inserted to the throttle body 1. Clearance s is set to a size enabling slight positional movement of the downstream side injector 5 having the seal 14 as a fulcrum.

Next, features for assembling the fuel injection apparatus of the present embodiment will be described with reference to FIGS. 1 to 5.

First, since the passage of fuel supplied to the upstream side injector 4 and the downstream side injector 5 is branched at the inside of the connecting pipe 6, the support structure is simplified as the fuel supply pipe 3 being required to support only the connecting pipe 6. Here, in the case of the fuel injection apparatus for a four-cylinder engine, for example, the fuel passage can be formed only by inserting the connecting pipes 6 at four positions 3*a*, 3*b*, 3*c*, 3*d* in total. Accordingly, it becomes easy to assemble the fuel supply pipe 3 being a pipe for the plural throttle bodies with the plural connecting pipes 6 at one time.

Then, the direction of the downstream side branch passage 6*b* in the connecting pipe 6 is set to be more to the downstream side than the direction of the upstream side injector 4 (i.e., angle α>angle β), in other words, to be closer toward the combustion chamber of the engine. The direction of the downstream side injector 5 is set to be more to the downstream side than the direction of the downstream side branch passage 6*b* (i.e., angle β>angle γ), in other words, to be closer toward the combustion chamber of the engine. In this manner, the direction of the downstream side injector 5 can be set to be closer toward the combustion chamber of the engine as being more to the downstream side than the direction of the upstream side injector. The angle between the upstream side injector 4 and the downstream side injector 5 (i.e., angle α−angle γ) is expressed by an addition of two angles of an angle of bifurcation within the connecting pipe 6 and an angle of connection from the connecting pipe 6 to the downstream side injector 5. Accordingly, the angle between the upstream side injector 4 and the downstream side injector 5 (i.e., angle α−angle γ) can be enlarged while suppressing respective angles of the bifurcation and connection. Accordingly, since fuel can be injected to a position close to the combustion chamber of the engine even with the fuel injection apparatus in which fuel is supplied to the upstream side injector 4 and the downstream side injector 5 from the single common fuel supply pipe 3, combustion efficiency of the engine combustion chamber is expected to be enhanced and the control accuracy of the air-fuel ratio is improved.

In the following, further effects of closing the injection direction of the downstream side injector 5 which is sub-assembled with the upstream side injector 4 and the connecting pipe 6 to the direction of the intake passage 2 will be described especially with reference to FIGS. 4A, 4B and 5.

Figure 4A:
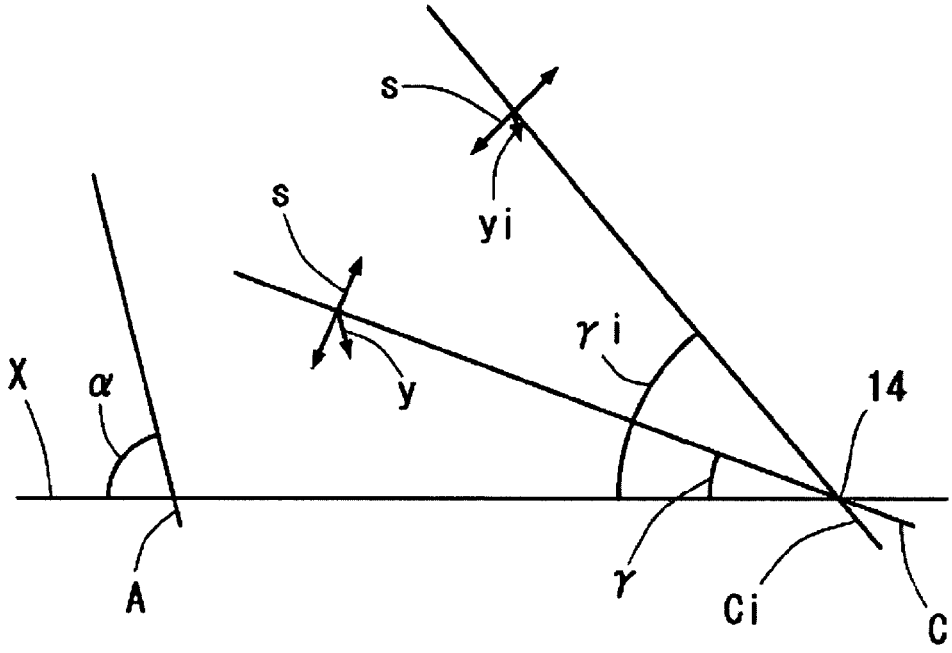
FIGS. 4A and 4B are views respectively illustrating functional effects based on arrangement relation of injectors of the fuel injection apparatus according to the embodiment.
Figure 4B:
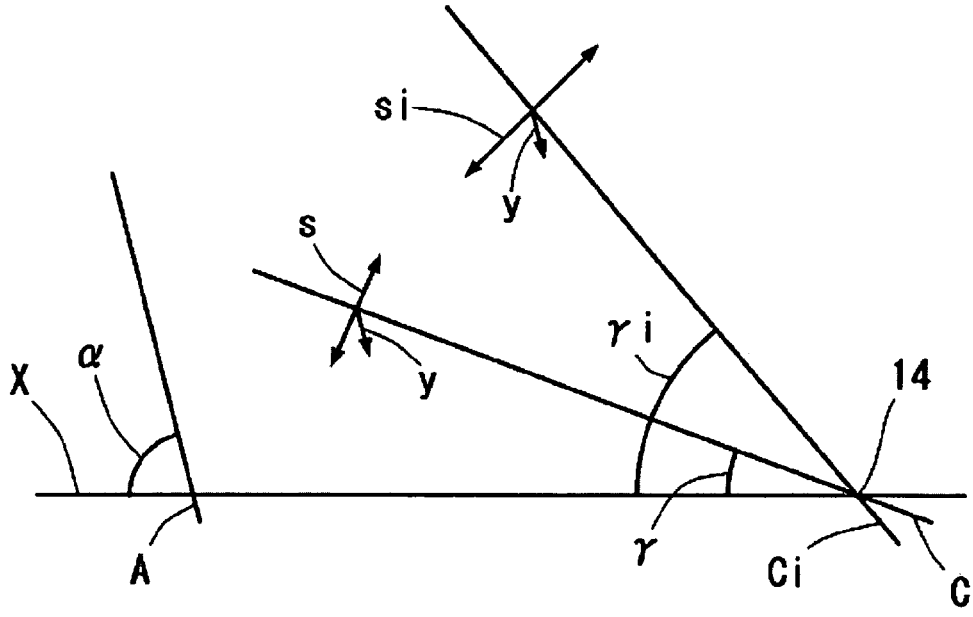
Figure 5:
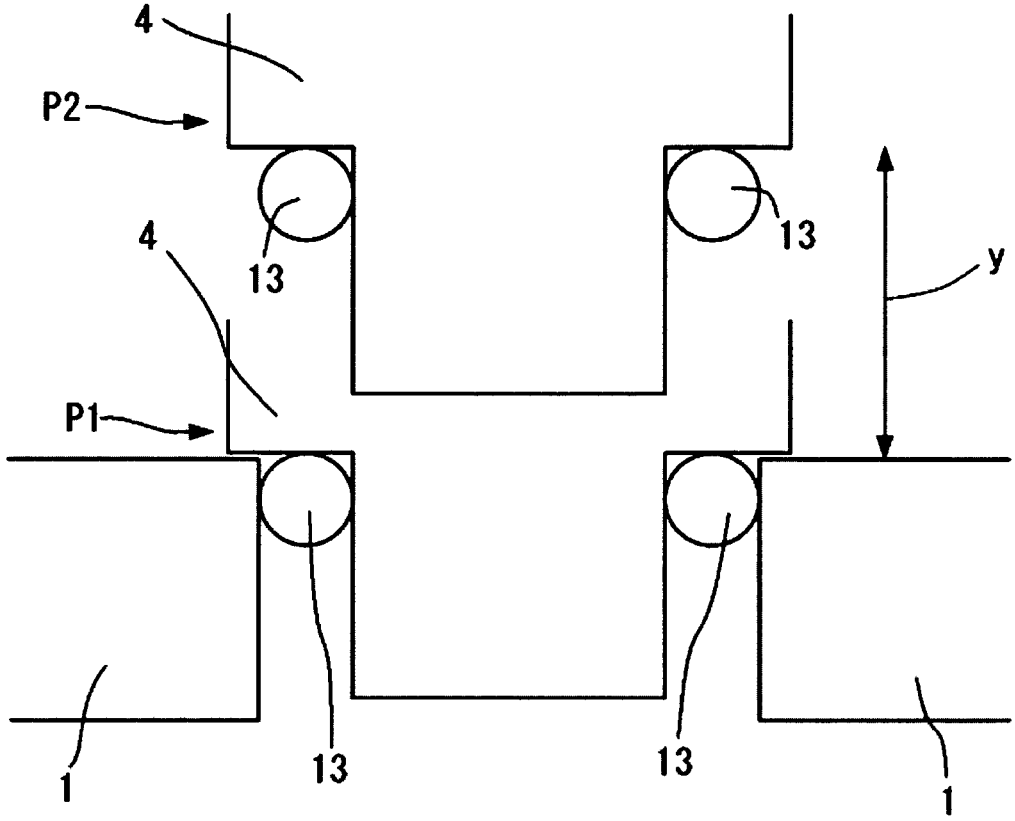
FIG. 5 is an enlarged view when assembling an upstream side injector of the fuel injection apparatus according to the embodiment.

Line Ci in FIGS. 4A and 4B denotes the fuel injection direction at the injection opening of the downstream side injector when the angle between the downstream side injector and the intake passage 2 is enlarged against that in the present embodiment to be described as comparison with the present embodiment for convenience of effect description. Here, the angle γi nipped by line Ci and line X is larger than angle γ nipped by line C and line X. Similarly, clearance si denotes the clearance between the downstream side injector and the throttle body 1 in the case that the angle between the downstream side injector and the intake passage 2 is enlarged against that in the present embodiment to be described as comparison with the present embodiment for description convenience.

When assembling the upstream side injector 4, the downstream side injector 5 and the connecting pipe 6 which are previously sub-assembled, the downstream side injector 5 is inserted to the throttle body 1, and then, the upstream side injector 4 is inserted to the throttle body 1 having the seal 14 at the inserted portion as a fulcrum.

Specifically, since clearance s exists between the downstream side injector 5 and the throttle body 1, the upstream side injector 4 can be remained not being inserted when the downstream side injector 5 is inserted. The position of the upstream side injector 4 is denoted by position P2 in FIG. 5. Subsequently, the upstream side injector 4 is further inserted to position P1 in FIG. 5. Margin y denotes distance between position P1 and position P2. Margin y corresponds to a dimension of a component in the fuel injection direction of clearance s. When margin y is large, it becomes easy to insert the upstream side injector 4 to the throttle body 1 having the seal 14 of the downstream side injector 5 as a fulcrum, so that assembling becomes easy.

Referring to FIG. 4A, margin y isolating the upstream side injector 4 and the throttle body 1 becomes larger than margin yi in the case that the angle between the downstream side injector and the intake passage 2 is set to be larger than that of the present embodiment against clearance s with which the downstream side injector 5 is slightly movable after being inserted to the throttle body 1. Here, margin yi denotes the margin for convenience of description against margin y of the present embodiment. As described above, by lessening the angle between the downstream side injector 5 and the intake passage 2, it is possible to obtain an effect that a variety shape of the upstream side injectors can be adopted due to easiness of assembling the upstream side injector 4 even in the fuel injection apparatus having two injectors supported by the common fuel supply pipe as in the present invention.

Further, referring to FIG. 4B, when the upstream side injector 4 integrated with the connecting pipe 6 and the downstream side injector 5 is to be assembled with a requisite minimum margin y, clearance s allowing slight movement of the downstream side injector 5 after being inserted to the throttle body 1 is to be smaller than clearance si in the case that the angle between the downstream side injector and the intake passage 2 is enlarged against that of the present embodiment. Accordingly, since excessive room is not required around the injection hole of the downstream side injector 5, it is possible to obtain effects that unnecessary turbulence of intake flow is suppressed and that unnecessary upsizing of the seal 14 is suppressed.

As described above; even with the fuel injection apparatus having two injectors assembled at one time due to commonality of the fuel supply pipe, the downstream side injector 5 sub-assembled with the upstream side injector 4 and the connecting pipe 6 can be arranged to have a small nip angle against the intake flow direction of the intake passage 2.

Meanwhile, in general, in the case that the downstream side injector 5 is to be arranged to have a small angle against the intake passage 2 in order to perform injection toward the combustion chamber of the engine, the downstream side injector 5 is required to be arranged at more downstream side against the upstream side injector 4 not to cause unacceptable bend at the fuel passage. Consequently, the throttle body is prolonged in the intake flow direction. However, according to the fuel injection apparatus of the present invention, since the angle between the upstream side injector 4 and the downstream side injector 5 is dependent to the angle of bifurcation within the connecting pipe 6 in addition to the angle of connection from the connecting pipe 6 to the downstream side injector 5, the distance between the downstream side injector 5 and the upstream side injector 4 can be shortened. Accordingly, even with the fuel injection apparatus having fuel supplied to the two injectors with the common fuel supply pipe 3, fuel can be injected to a position close to the combustion chamber of the engine while suppressing the length of the throttle body 1 in the intake flow direction.

Figure 3:
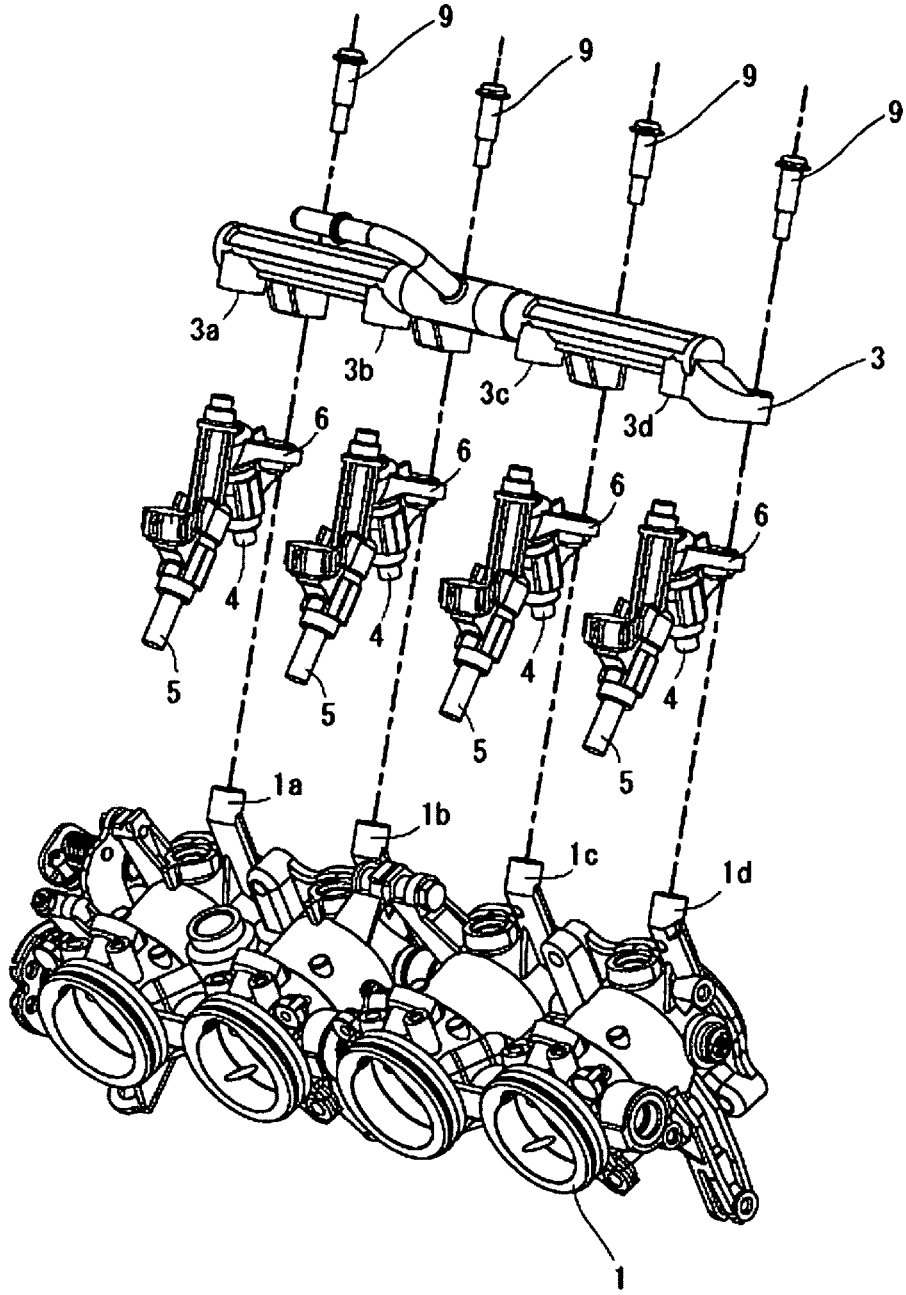
FIG. 3 is a view illustrating a state of fixing main structural portions with fixing members of the fuel injection apparatus according to the embodiment.

Further, as illustrated in FIG. 3, since the fuel supply pipe 3 and the connecting pipe 6 are fixed to the throttle body 1 as being simultaneously fixed with the common fixing member 9, it is possible to lessen variation of the angle of the downstream side injector 5 due to instability of the connecting pipe 6 and to prevent occurrence of an unintentional angle of the downstream side injector 5 caused by increased fuel pressure. Further, possibility of fuel leakage from the portion of the seal 12 of the connecting pipe 6 can be reduced. In addition, it is also possible to prevent occurrence of hitting noise and vibration noise caused by vibration of the downstream side injector 5 and the connecting pipe 6 having the seal 12 as a fulcrum.

Accordingly, the embodiments are applicable to a fuel injection apparatus for a vehicle of which intake air quantity through an intake passage is controlled for each cylinder of an engine, for example, especially for a motorcycle.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A fuel injection apparatus comprising:

a plurality of throttle bodies in which an intake passage communicated with an engine is respectively formed, each throttle body including an upstream side injector to inject fuel to the intake passage and a downstream side injector arranged at the downstream side of the throttle body against the upstream side injector to inject fuel to the intake passage;

a fuel supply pipe to commonly supply fuel to the upstream side injectors and the downstream side injectors; and a plurality of connecting pipes, a respective connecting pipe connecting the fuel supply pipe to the upstream side injector and the downstream side injector of a respective throttle body;

wherein an upstream side branch passage to supply fuel branched from the fuel supply pipe to the upstream side injector is formed inside each of the plurality of connecting pipes, a downstream side branch passage to supply fuel branched from the fuel supply pipe to the downstream side injector is formed inside each of the plurality of connecting pipes, a nip angle of the upstream side injectors is larger than a nip angle of the downstream side branch passages against an intake flow direction of the intake passage, and the nip angle of the downstream side branch passages is larger than a nip angle of the downstream side injectors against the intake flow direction of the intake passage.

2. The fuel injection apparatus according to claim 1, wherein the plurality of throttle bodies are integrally molded.

3. The fuel injection apparatus according to claim 1, wherein the fuel supply pipe and each connecting pipe are fixed respectively to each throttle body commonly with respective fixing members.

4. The fuel injection apparatus according to claim 1, wherein a pair of throttle bodies of the plurality of throttle bodies are integrally molded together.

5. The fuel injection apparatus according to claim 4, comprising two pairs of integrally molded throttle bodies.

6. The fuel injection apparatus according to claim 1, further comprising a plurality of seals, a first seal sealing the fuel supply pipe to a respective connecting pipe, a second seal sealing the connecting pipe to the respective upstream side injector, and a third seal sealing the connecting pipe to the respective downstream side injector.

7. The fuel injection apparatus according to claim 6, wherein the plurality of seals are flexible.

8. The fuel injection apparatus according to claim 7, wherein the plurality of seals are o-ring seals.

* * * * *